United States Patent [19]

Barlow et al.

[11] Patent Number: 4,556,586

[45] Date of Patent: Dec. 3, 1985

[54] PAINT MACHINE AND METHOD OF OPERATION

[76] Inventors: Joel H. Barlow; Michael Michaels, both c/o Inland Fabricators, Inc., 1734 Inland Dr., Ottawa, Ill. 61350

[21] Appl. No.: 674,179

[22] Filed: Nov. 19, 1984

[51] Int. Cl.[4] ..... B05D 5/00; B05D 1/32; B05B 13/02; B05B 15/04

[52] U.S. Cl. ..... 427/282; 118/301; 118/319; 118/697; 427/421

[58] Field of Search ..... 118/301, 319, 213, 230, 118/504, 697; 427/282, 424, 425, 421

[56] References Cited

U.S. PATENT DOCUMENTS

| | | | |
|---|---|---|---|
| 3,104,181 | 9/1963 | Minnick | 118/504 X |
| 3,117,025 | 1/1964 | Learn et al. | 118/504 X |
| 3,356,069 | 12/1967 | Martin | 118/301 |
| 3,532,072 | 10/1970 | Kiwiet | 118/301 |

*Primary Examiner*—Evan K. Lawrence
*Attorney, Agent, or Firm*—Wood, Dalton, Phillips, Mason & Rowe

[57] ABSTRACT

Two separate indexing mechanisms, one for parts and one for shields, are operated to repetitively paint selected surfaces of parts. The mechanisms are overlapped at a paint station in which one shield and one part are mated and the part is then painted. New parts are continuously indexed into the paint station for painting. When the shield at the paint station should be cleaned, the shields are indexed so that the shield at the paint station is moved to a wash station, and at the same time a clean shield is moved into the paint station for continued painting without interruption. The booths provided for the paint and wash stations may also be periodically indexed with the shields for washing therewith.

12 Claims, 10 Drawing Figures

FIG. 6A
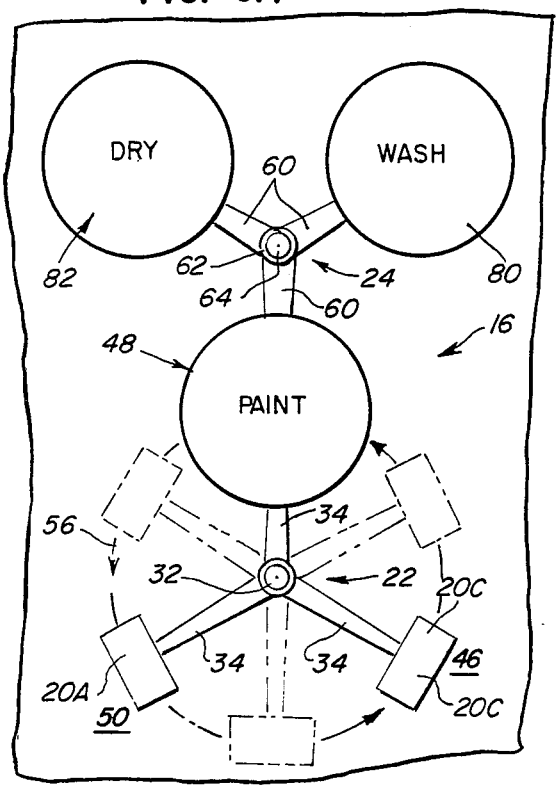
FIG. 6B
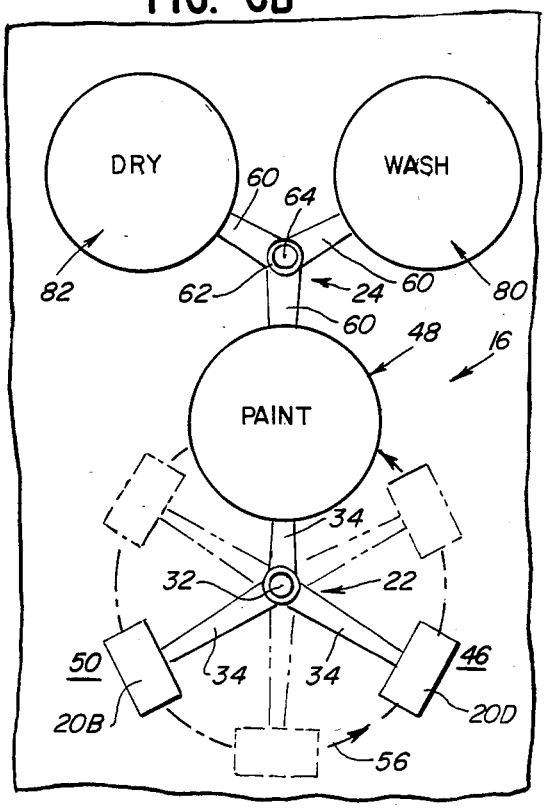
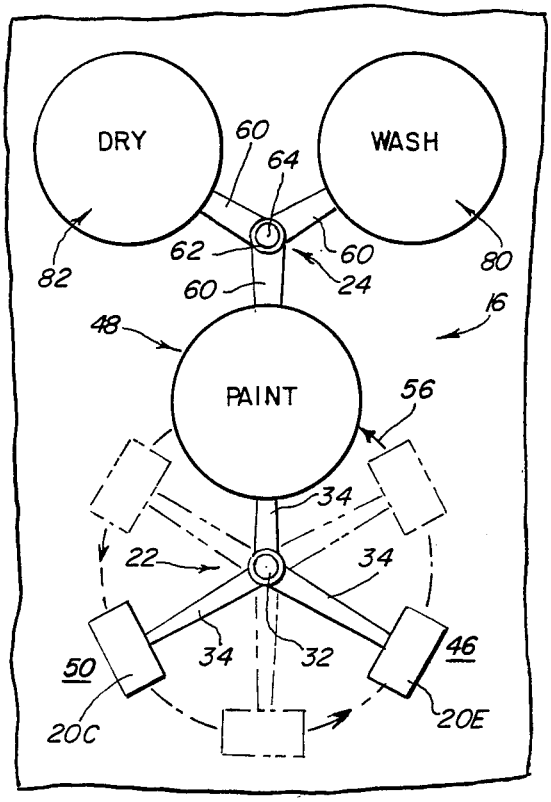
FIG. 6C
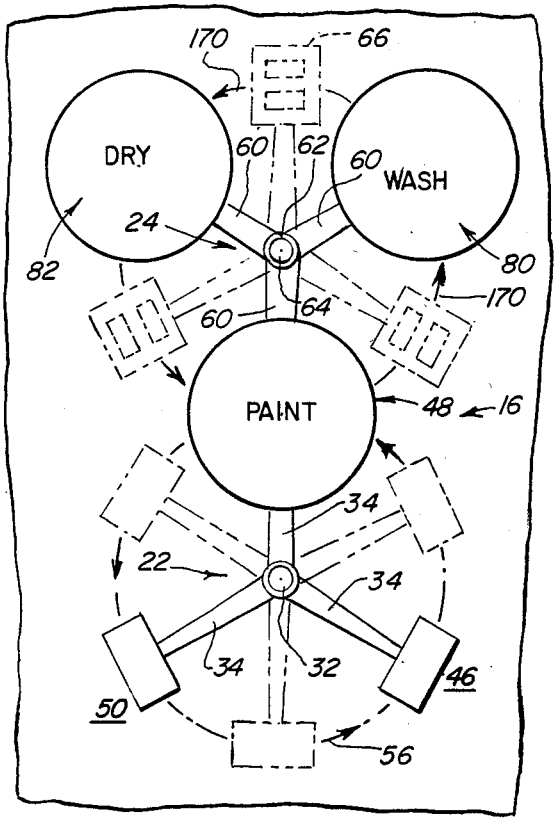
FIG. 6D

PAINT MACHINE AND METHOD OF OPERATION

BACKGROUND OF THE INVENTION

1. Technical Field

The present invention relates to a method and apparatus for painting parts, and more particularly to a method and apparatus for repetitively and automatically mating parts with shields and painting the unshielded surfaces of the parts.

2. Background Art

Paint systems are known in the art in which shields are mated with parts to shield certain surfaces so that only selected surfaces of the part are painted by a paint spray. Such systems are typically used in large volume industries such as the automotive industry where it is necessary to paint thousands and even millions of the same part (e.g. tail lights or grills).

Shields which are used in such painting operations can cost from $2,000 to $5,000 each depending upon the part being painted. Shields naturally get paint on them during the painting process and therefore it is required that the shields be changed occasionally for cleaning the paint therefrom. As a result, 8–10 shields are typically required for each system. Further, since the system must be stopped while the shields are changed, the down time resulting from shield changing causes a substantial reduction in productivity for the system. Changing shields also requires that the shields be handled, and inevitably the shields are mishandled and damaged, resulting in significant costs for shield maintenance.

Since painting in the prior art systems is accomplished by using a paint spray, the parts have necessarily been placed in closed areas or booths during painting. Paint of course gets on the walls of the booths, which must necessarily also be cleaned, again resulting in down time (typically 10% of operating time) and decreased productivity. Further, the booths of the prior art systems generally have required pits beneath them within which waste from the painting process is received. As a result, the booths are difficult to install and require that floor space (normally 500 square feet per booth) be dedicated for the booth.

Further, the painting systems of the prior art are generally operator controlled, which allows the operator to work at his own pace. Studies have shown that this most often results in less than maximum productivity from an operator.

Further, in some prior art paint systems, the operator is located in the booth during painting and safety and health standards require that large amounts of air be moved through the booth (e.g. 10,000 cubic feet per minute). Such a large air flow results in substantial heating costs in cold climates. Further, in order to provide for such air flow, a large initial capital outlay is usually required for the equipment capable of moving and heating that amount of air, and large operating expenses, particularly energy costs, are incurred in running that equipment.

The present invention is directed toward overcoming one or more of the problems as set forth above.

SUMMARY OF THE INVENTION

An apparatus and method of operation are disclosed in which two separate indexing mechanisms, one for parts and one for shields, are operated to repetitively paint selected surfaces of parts. The mechanisms are overlapped at a paint station in which one shield and one part are mated and the part is then painted. New parts are continuously indexed into the paint station for painting. When the shield in the paint station should be cleaned, the shields are indexed so that the shield in the paint station is moved to a wash station, and at the same time a clean shield is moved into the paint station for continued painting without interruption. The booths provided for the paint and wash stations may also be periodically indexed with the shields for washing therewith.

The paint machine of the present invention may easily be relocated on a factory floor since no pit is required. Further, a paint machine embodying the present invention and including two units (i.e. two different paint operations) requires only 400 square feet of floor space.

Still further, the booth in which painting is done with the present invention may be sized according to the size of the part being painted. The booth size and thus its cost are minimized. Air flow requirements in the paint booth are as a result also minimized, thereby reducing capital costs for the equipment required to circulate air and also reducing energy costs in operating that equipment. Heating costs are also minimized, a substantial savings in cold climates.

With the present invention, only four total shields are required for continuous operation of each unit, where one of the four shields functions as a standby. The shields are automatically cleaned during operation, so there is no down time in changing the shields during cleaning and thus no loss of productivity from cleaning the shields. Further, since the shields are handled only infrequently, maintenance costs are minimized. Still further, since the shields may be cleaned without causing down time for the machine, the shields may be cleaned more frequently than in the prior art and will thus result in more precise painting (inasmuch as paint will not be allowed to build up around the edges of the shield).

Down time for washing the paint booth is also eliminated.

In addition to increasing productivity by virtually eliminating down time, increased productivity is also provided by the paced operation of the present invention. Inasmuch as the painting process is machine controlled to index the components after selected periods of time, the operator must work at the pace of the machine rather than at his own pace. Historically, machine paced operations have been found to increase productivity from 15% to 20% over the productivity of unpaced operations. A single operator can run two or more units of the present invention at the same time, as in some operations, labor may be virtually entirely eliminated.

BRIEF DESCRIPTION OF THE DRAWINGS

FIGS. 6A—6D illustrate the operation of the present invention.

DESCRIPTION OF THE PREFERRED EMBODIMENT

Figure 1:
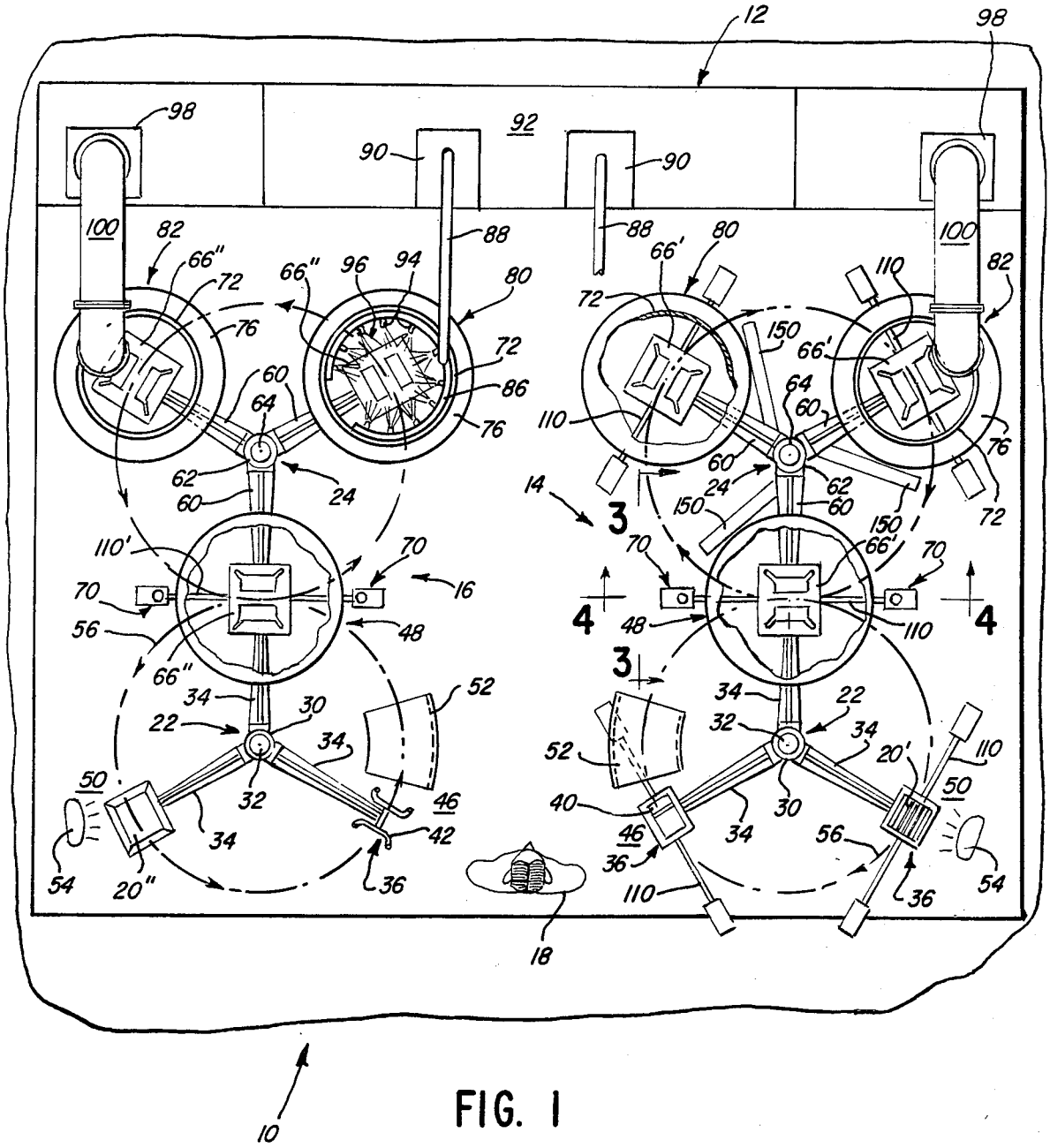
FIG. 1 is a plan view of a paint machine of the present invention.

FIG. 1 illustrates the paint machine 10 of the present invention. The machine 10 is compact and can be constructed on a base 12 which does not require a pit in the floor beneath it as many prior art paint booths do.

The machine 10 includes two separate units 14,16 which can both be run by one operator 18, thereby providing for maximum productivity of the operator 18. In some situations (in particular where the painting operation is sufficiently slow), an operator 18 could run more than two units.

Two different types of units 14,16 are shown in the machine 10 of FIG. 1. The first unit 14 is usable to paint open parts 20', while the second unit 16 is adapted for painting solid parts 20". If only one type of part is being painted, the two units would of course be the same. However, in installations where two different types of parts 20',20" are being painted such as shown, the machine 10 is configured with two different types of units 14,16.

Reference will first be had to both units 14,16 in general where like components are given like reference numerals.

Each unit 14,16 has a part indexing mechanism 22 and a shield indexing mechanism 24.

The part indexing mechanism 22 includes a sleeve or turret 30 mounted for rotation about a vertical shaft 32. The turret 30 has three equally spaced (at 120°) radial arms 34.

On the end of each radial arm 34 is a support 36 for a part 20. The supports 36 are provided to properly orient the parts 20 for painting as will be apparent.

The supports 36 shown with the first unit 14 are pads 40 which conform to the bottom of the part 20' enabling the operator 18 to properly orient the part 20' thereon. Such pads 40 are typically made of low durometer polyurethane material.

A second type of support 36 is shown with the second unit 16. This support has fingers 42 which support and orient the part 20" to be painted. Such finger supports 42 are especially advantageous in automatic operations where a mechanical arm may be used to load the machine 10 since the finger supports 36 ensure precise orientation of the part 20" placed thereon.

Still other types of supports 36 could of course be used with the present invention.

The part indexing mechanism 22 indexes the radial arms 34 (and supported parts 20) between three stations: the load/unload station 46, the paint station 48 and the flash station 50.

Parts 20 are loaded and unloaded on the supports 36 at the load/unload station 46. This can be done manually or mechanically as previously described.

Both units 14,16 of the paint machine 10 are typically controlled in their operation by a suitable computer control (not shown). The computer control may be programmed to adjust the machine operation in accordance with the requirements of the particular painting operation being done. Further, the computer control paces the operation of the machine 10 for the operator 18 so that the operator's productivity may be maximized.

The parts 20 are painted at the paint station 48, which is described in detail further below. Between the load/unload and paint stations 46,48 is an anti-static blowoff station 52. The blowoff station 52 provides an ionized air wash to the parts 20 as they pass by it while indexing between the load/unload and paint stations 46,48. The air wash helps to clear dirt from the part 20 before it is painted.

The flash station 50 has an infrared light 54 which removes some of the solvent from the paint on the just painted part 20, thereby providing an accelerated drying period prior to handling when unloaded at the load/unload station 46.

Indexing between stations 46–50 occurs through rotation of the turret 30 in the direction of the arrows 56 so that each part 20 is moved in a cycle through each station and the cycles are constantly repeated. Operation of this mechanism 22 is more fully described hereafter.

The shield indexing mechanism 24 has three radial arms 60 also spaced at 120° and rotatable with a sleeve or turret 62 about a second vertical shaft 64. Suitably secured to the end of each arm 60 is a shield 66',66".

The shields 66',66" are such that they may be mated over the top of the part 20',20" to be painted so as to cover those portions of the part 20',20" which are not to be painted while at the same time allowing paint to pass to those portions which are to be painted. Shields used such as this are known in the art and can cost $2,000 or more each.

The vertical shafts 32,64 of the two indexing mechanism 22,24 are spaced so that directly between the shafts 32,64, a shield 66' or 66" may be positioned above a part 20' or 20" at the paint station 48. A pair of cylinders 70 (see particularly FIG. 3) are disposed on either side of the paint station 48 to raise the supported part 20' or 20" into the shield 66' or 66" in preparation for painting as will be more fully described hereafter.

The paint station 48 is enclosed by a booth 72 and a housing portion 76 (see particularly FIG. 3) as is also more fully described hereafter. The booth 72 may be tailored to fit the size of the parts 20' or 20" being painted, thereby minimizing the cost of heating and other environmental controls necessary for the painting environment.

The shield indexing mechanism 24 rotates the shields 66' or 66" about the vertical shaft 64 to index the shields 66' or 66" between the paint station 48 and a wash station 80 and dry station 82. The wash and dry stations 80,82 are enclosed by booths 72 identical to the booth 72 at the paint station 48 as will be apparent from the description hereafter.

A high pressure spray header 86 (see the second unit 16 of FIG. 1) is disposed at the wash station 80. A conduit 88 connects the header 86 to a pump 90 which pumps water from the water tank 92 for washing. A plurality of nozzles 94 are provided about the header 86 to create a spray 96 throughout the wash station 80. The spray header 86 is suitably supported independently of the booth 72 at the wash station 80 so that the booths 72 may be indexed with the shields 66' or 66" (as is discussed further below). The header 86 is further suitably supported so that it may be moved up and down through the booth 72 to ensure that the entire height of the booth 72 is washed. A suitable connection (not shown) is provided from the bottom of the wash station 80 to the water tank 92 for recirculation of the wash water.

At the dry station 82, the booth 72 is connected to an air intake and fan 98 by a flexible duct 100 so as to provide a flow of air therethrough for drying. An exhaust duct 102 (see FIG. 5) is provided at the bottom of the dry station 82 for exhaust air.

Figure 2A:
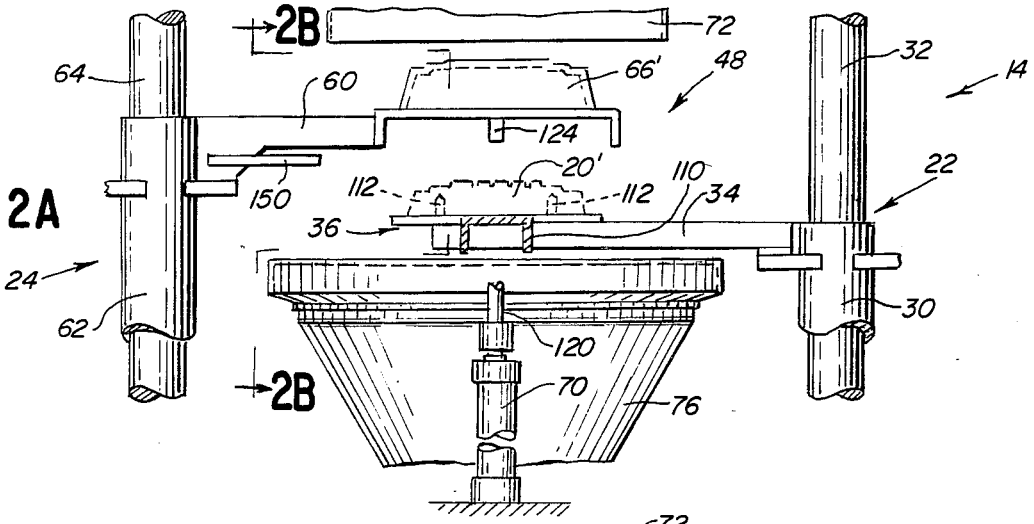
FIG. 2A is a view of the paint station with the housing portions positioned as during indexing.

Referring now more specifically to the paint station 48 of the first unit 14, reference will be had to FIGS. 2A through 4 showing the structure in detail. FIGS. 2A and 2B show a part 20' supported on a pad 40 which is itself secured to a tangential arm 110 in the form of a downwardly open channel. The tangential arm 110 and pad 40 rest on the radial arm 34 and are held in place thereon by four pins 112 on the radial arm 34 which are received in openings 114 in the pad 40. The tangential arm 110 and pad 40 are thus securely carried by the radial arm 34 but can be lifted vertically therefrom.

The ends of the tangential arm 110 have downwardly facing concave surfaces 116 (see FIGS. 2B and 3) within which are received the upwardly facing mating convex surfaces 118 (see FIG. 5) on the upper ends of the rods 120 of the support cylinders 70. Therefore, the cylinders 70 may be used to lift the tangential arm 110 and pad 40 to raise the supported part 20' into the shield 66' located thereabove. To ensure proper mating of the part 20' and shield 66', pins 124 fixed to the shield 66' are received within bushings 126 as the tangential arm 110 is raised to the shield 66' as shown in FIG. 3.

Figure 2B:
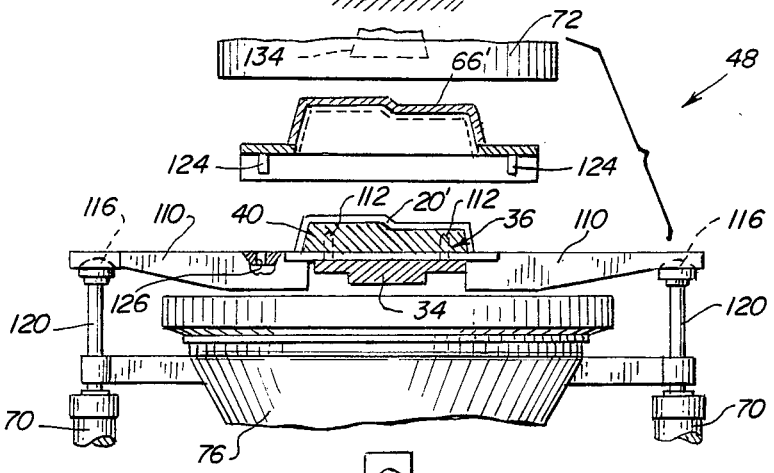
FIG. 2B is a view taken along line 2B—2B of FIG. 2A.

The booth 72 and housing portion 76 are vertically spaced at the paint station 48 so that the indexing mechanism 22,24 can be rotated to locate different radial arms 34,60 and supported parts 20' and shields 66' at the paint station 48. Specifically, the housing portion 76 is secured to the rods 120 of the cylinders 70 so as to be raised and lowered therewith. The booth 72 is supported so that it may be raised clear of (as shown in FIGS. 2A and 2B) or lowered down over (as shown in Fig. 3) the shield 66'. The support of the booth 72 is detailed further below with reference to FIG. 5.

Figure 3:
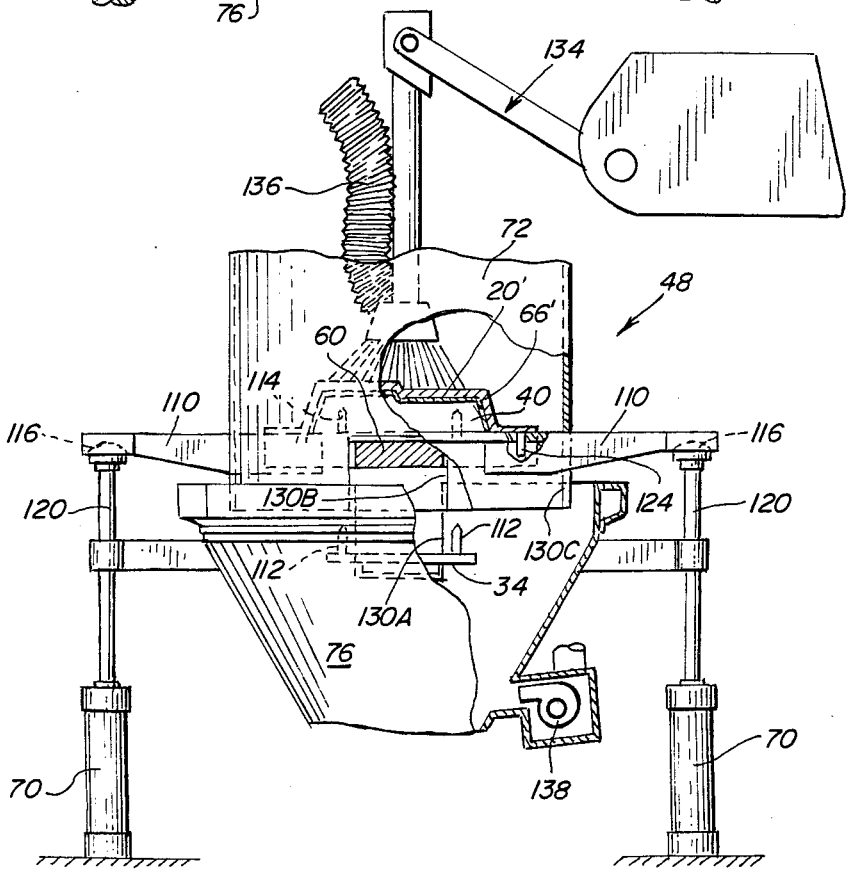
FIG. 3 is a view from the perspective of FIG. 2B but showing the paint station during painting.
Figure 5:
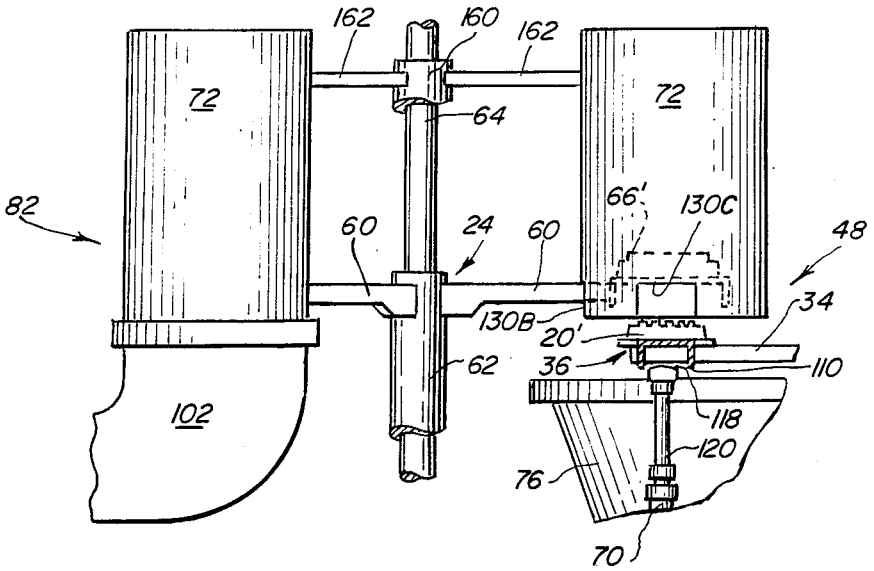
FIG. 5 is a view of a support for the upper housings.

Suitable slots 130A–C such as shown in FIGS. 3 and 5 are provided in the booth 72 and housing portion 76 to allow the booth 72 and housing portion 76 to be lowered and raised over the respective radial arms 60,34. Though not shown in the figures, suitable flaps can be provided on the booth 72 and on the housing portion 76 to fit into the slot 130A–C of the opposite part (i.e. housing portion 76 and booth 72) so that the paint station 48 is substantially closed over the arms 34,60,110 during painting.

The paint station 48 is shown during painting in FIG. 3. The booth 72 and housing portion 76 are closed together and the part 20' is mated into the shield 66'. A suitable robot paint sprayer 134 is used to paint the part 20'. A blower 136 is secured to the paint sprayer 134 and is used to flood the booth 72 with clean dry air, thereby keeping moisture off the part 20' and avoiding "blushing" (i.e. slight discoloration of the paint which can result when moisture is on the painted part 20'). The blower 136 also acts together with the fan 138 in the housing portion 76 to circulate air down through the booth 72 and housing portion 76 during painting.

The housing portion 76 is a water curtain funnel which functions as a venturi discharge at the paint station 48. Venturi discharges are known in the art to create a turbulence in the discharge to help separate the paint from water, thereby allowing the water to be recycled into the water tank 92 through a suitable connection (not shown).

With the first unit 14, the supports 36 may, when desired, be carried by the shield indexing mechanism 24 for washing the supports 36 together with the shields 66'. As previously indicated, the first unit 14 is illustrative of the type used with an open part 20' such as a grill. Since the openings in the part 20' allow paint to pass through the part 20', the supports 36 will get paint thereon and thereby require occasional cleaning.

Figure 4:
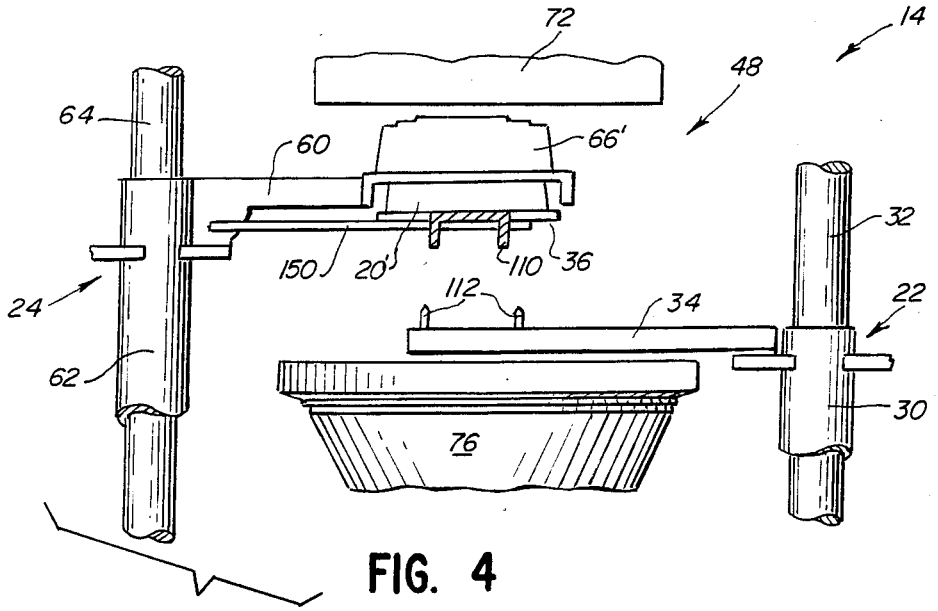
FIG. 4 is a view similar to FIG. 2A but showing the part support carried by the shield indexing mechanism.

A spatula 150 is provided with each radial arm 60 of the shield indexing mechanism 24 to carry the supports 36 to the wash and dry stations 80,82 together with the shields 66'. As shown in FIG. 4, when the cylinders 70 have raised the tangential arm 110 to move the pad 40 into the shield 66', the spatula 150 may be pivoted out beneath the tangential arm 110 when the booth 72 has been raised out of the way. When the cylinders 70 are thereafter lowered, the tangential arm 110 and entire support 36 remain supported on the spatula 150 and will therefore rotate with the shield indexing mechanism 24.

Of course, there are any number of structures which might otherwise be used to accomplish the above-described transfer between the indexing mechanisms 22,24.

Operation of the unit 14 so as to wash the pads 40 with the shields 66' is described in further detail below.

The second unit 16 is substantially the same as the first unit 14. However, since the second unit 16 is used to paint a part 20" which is solid, the support 36 (e.g. the finger support 42 shown in FIG. 1) does not get paint on it and therefore does not require washing. As a result, the second unit 16 may be slightly simplified from the first unit 14. Specifically, the shield indexing mechanism 24 of the second unit 16 does not have spatulas. Further, the tangential arm 110' used to raise the support 36 with a part 20" thereon into the shield 66" may be kept at the paint station 48. As a result, only one tangential arm 110' is required with the second unit 16 (versus a preferred number of five tangential arms 110 with the first unit 14). This single tangential arm 110' may be raised to engage and lift the support 36 off the radial arm 34 of the part indexing mechanism 22 so as to raise the supported part 20" into the shield 66" for painting. This structure is not illustrated in detail in the figures, though with the above description, it should be easily understood by a person skilled in the art.

FIG. 5 illustrates a structure for supporting the booths 72 for rotation about the vertical shaft 64 of the shield indexing mechanism 24. This structure includes a sleeve 160 adjustably supporting the booths 72 on the end of radial arms 162. The booths 72 are rigidly fixed to the radial arms 162 to raise and lower together with the sleeve 160.

The sleeve 160 is adapted to index the booths 72 with the turret 62 of the shield indexing mechanism 24 at selected times. Since the booths 72 receive less paint per unit area than the shields 66, and even that paint which the booths 72 receive is not particularly crucial to operation, the booths 72 can be indexed infrequently for washing, for example, only once every two to four hours. Further, inasmuch as the booths 72 move with the shield indexing mechanisms 24 when they are indexed, there is no down time involved in washing the booths 72. This is a substantial savings over the prior art, in which 10% of the operating time is often required merely to clean the booths.

Operation of the paint machine 10 is thus as follows. Reference is first made to the operation of the second unit 16 as that utilizes only the basic operating principles of the present invention. Reference will then be had to the operation of the first unit 14, which embodies the slightly more complex method of operation in which the part supports 36 are washed as well as the shields 66'.

FIGS. 6A–6D illustrate the basic operation of the present invention. A unit 14 is shown during operation in FIG. 6A in which a part 20A–20C is supported on each arm 34 of the part indexing mechanism 22. One part 20A is at the flash station 50, having just been painted at the paint station 48. The infrared light 54 at the flash station 50 is drying the part 20A. Another part 20B (not seen in FIG. 6A) is supported at the paint station 48 and is being painted. At the load/unload station 46, an unpainted part 20C has been loaded onto the support 36 (replacing another part which has just been painted and flashed).

At the end of a selected period of time sufficient to allow the part 20B at the paint station 48 to be painted (typically on the order of 13–15 seconds), the paint station 48 is opened (i.e. the cylinders 70 are lowered) to place the unit 14 in the position shown in FIG. 5. Since the paint might stick the part 20 in the shield 66, spring-loaded pins (not shown) can be provided with the shield 66 which will knock the part 20 from the shield 66 as the support 36 is lowered.

The part indexing mechanism 22 is then indexed (i.e. rotated 120°) as indicated by the arrows 56 to place it in the position of FIG. 6B. As this occurs, the new part 20C is cleaned as it passes the anti-static blowoff station 52. This indexing step may be accomplished in 1–2 seconds.

The paint station 48 is then closed to the position shown in FIG. 3 and the part 20C therein is painted. The part 20B just painted is simultaneously flashed at the flash station 50 (i.e. the infrared light 54 removes some of the paint solvent). Further, the part 20A just flashed is removed by the operator and replaced with yet another part 20D. A conveyor (not shown) may be positioned behind the operator 18 from which he can obtain unpainted parts 20 and on which he can place painted parts.

At the end of the selected time period, the above steps are repeated once again, with a new piece 20E being loaded onto the support 36 at the load/unload station 46 and the part 20C originally loaded in FIG. 6A flashed at the flash station 50 as indicated in FIG. 6C.

It is apparent that if flashing is desirable for a longer time that painting, the part indexing mechanism could be provided with, for example, four radial arms and two successive flashing stations, resulting in each part being flashed twice as long as the time required to paint it without any decrease in productivity.

Absent any mechanical failures, the above-described indexing of the part indexing mechanism 22 may be repeated without pause for many hours on end if desired with one part 20 painted about every 15 seconds (or even more frequently depending upon the part).

Indexing of the shield indexing mechanism 24 is shown in FIG. 6D. Inasmuch as the shields 66 do not need to be washed after every part 20 is painted, the shield indexing mechanism 24 is not indexed as frequently as the part indexing mechanism 22. Typically, the shield 66 in the paint station 48 will collect enough paint so as to require washing after five parts 20 have been painted. In that case, the shield indexing mechanism 24 will index (as indicated by the arrows 170) every fifth time that the part indexing mechanism 22 indexes.

At the completion of painting of the last part 20 prior to indexing the shields 66, the booth 72 is raised to the position shown in FIGS. 2A, 2B and 4. As the part indexing mechanism 22 rotates as previously described, the shield indexing mechanism 24 also rotates to move the shield 66 from the paint station 48 to the wash station 80. The shield 66 which has been washed will simultaneously be moved to the dry station 82 and the shield 66 which has been washed and dried will be moved into the paint station 48 for use in painting the next five (or other selected number) parts 20.

As a result, each shield 66 will spend close to $1\frac{1}{4}$ minutes at each station 48,80,82 where the part indexing mechanism indexes every 15 seconds as in the example given above. Of course, frequency of indexing the shield indexing mechanism depends upon the shield 66, the manner of painting, etc. and in many cases could be done less frequently than the example used above.

The first unit 14 operates basically as described above for the second unit 16 with a slight modification when the shield indexing mechanism 24 is to be indexed to allow the support 36 to be cleaned as well. Specifically, when the shield 66 at the paint station 48 requires washing, a support 36 is indexed into the paint station 48 without a part 20 on it. When the support 36 is then lifted by the cylinders 70, the spatula 150 is pivoted beneath the support 36 so that, when the cylinders 70 are retracted down, the support will remain with the shield 66 such as shown in FIG. 4.

The shield indexing mechanism 24 is then indexed to move the shield 66 and support 36 from the paint station 48 to the wash station 80 and a clean and dry shield 66 and support 36 are indexed into the paint station 48 from the dry station 82.

The cylinders 70 are then raised to engage the tangential arm 110 of the support 36 and the spatula 150 is retracted to free the support 36 from the shield indexing mechanism 24. The unit 14 is then operated as if a part 20 had just been painted. That is, the cylinder 70 retracts to lower the support 36 onto the radial arm 34 of the part indexing mechanism 22 which is then indexed to move a supported part 20 into the paint station 48 from the load/unload station 46.

The part indexing mechanism 24 is then repeatedly indexed as previously described to paint a plurality of parts 20 until the shield 66 and support 36 therein require washing, at which time the above-described operation is repeated.

While the most efficient operation can be accomplished where five supports 36 are provided as shown in FIG. 1, the unit could nonetheless be provided with just three supports. While a support 36 is being washed and dried however, the part indexing mechanism 22 would necessarily be operated with just two supports, and as a result one of every three paint cycles would pass without a part being painted.

Indexing of the booths 72 for washing as previously described would be accomplished in substantially the same manner as described above with respect to the shields 66.

With an understanding of the above-disclosed embodiments and their methods of operation, those skilled in the art will recognize that there are a large number of structures which could be used within the scope of the present invention. Still further aspects, objects and advantages of the present invention can be obtained from a study of the drawings, the disclosure and the appended claims.

We claim:

1. An apparatus for painting parts, comprising:

a part indexing mechanism rotatable about a first axis and having first and second means for supporting a part at a first radial distance from said first axis;

a shield indexing mechanism rotatable about a second axis and supporting first and second shields a second radial distance from the second axis, said first and second axes being spaced whereby one of said shields may be aligned with one of said support means at a paint station between said axes;

means for mating an aligned shield and a supported part at the paint station;

means for painting a part when mated with a shield at the paint station; and means for washing paint from one shield when the other shield is at the paint station, said shield indexing mechanism rotating about the second axis to move the shields between the paint station and the washing means.

2. The apparatus of claim 1, further comprising means for enclosing a mated part and shield at the paint station.

3. The apparatus of claim 2, further comprising a second enclosing means and means for mounting both enclosing means for selective rotation with the shields whereby the washing means is also adapted to wash paint from the enclosing means not at the paint station.

4. The apparatus of claim 1, wherein said first and second axes are spaced apart a distance substantially equal to the sum of the first and second radial distances.

5. The apparatus of claim 1, wherein the aligned shield is above a supported part at the paint station and said mating means comprises a cylinder adapted to raise the supported part into the shield.

6. The apparatus of claim 1, further comprising:

a third shield supported by the shield indexing mechanism for rotation with the first and second shields;

means for drying a shield; and means for rotating said shield indexing mechanism to locate the shields, in order, at the paint station, the washing means, and the drying means, with one shield at each location.

7. The apparatus of claim 1, further comprising:

a third supporting means on the part indexing mechanism; and means for rotating the part indexing mechanism whereby a supported part is moved from the paint station to an intermediate flash station, and thereafter is moved to a load station where the supported part may be replaced by an unpainted part prior to being located at the paint station.

8. An apparatus for painting parts, comprising:

a part indexing mechanism rotatable about a first axis and having three arms extending from the first axis, said arms being at substantially 120° spacing from each other and adapted to support parts at a first radial distance;

a shield indexing mechanism rotatable about a second axis and supporting two shields at a second radial distance from the second axis, said shields being angularly spaced from one another, and said axes being spaced from one another a distance substantially equal to the sum of the first and second radial distances whereby one of the shields may be supported above a supported part at a paint station between the axes;

a cylinder at the paint station adapted to mate a supported part with the shield supported at the paint station;

a paint sprayer adapted to paint the mated part at the paint station;

a drive for rotating the part indexing mechanism to locate each supported part successively at the paint station, a flash station and a load station for selected periods of time;

a drive for rotating the shield indexing mechanism to move the shields between the paint station and a wash station during selected times in the operation of the apparatus; and means for washing paint from a shield supported at the wash station.

9. The apparatus of claim 8, further comprising:

a third shield supported by the shield indexing mechanism, said shields being at substantially 120° spacing from one another; and means for drying a washed shield, said drying means being located at a dry station between the wash station and paint station around the second axis, whereby the shield indexing mechanism drive moves each shield through repeated cycles in the paint station, wash station, and dry station successively.

10. A method for repetitively painting parts having portions thereof protected by a shield, there being one shield mounted on each arm of a first rotatable turret, comprising the steps of:

rotating the first turret to locate one of the shields at the paint station;

placing a part to be painted on one support of a second turret having two supports rotatable together around an axis;

rotating the second turret to locate a supported part beneath the shield located at a paint station;

mating the part and shield at the paint station;

painting the part at the paint station;

placing another part on the other first turret support;

disengaging the part from the shield at the paint station; and repeating the placing through disengaging steps at least a selected number of times for each repetition of the step of rotating the first turret, and further comprising the step of washing the shield which is not located at the paint station.

11. The method of claim 10, wherein there are two booths, one of which is provided at the paint station during the painting step, and further comprising the steps of:

rotating the booths with the first turret no more often than once for every 25 steps of rotating the first turret; and washing the booth associated with the shield being washed.

12. A method for painting parts having portions thereof protected by a shield, wherein at least two shields are mounted on a first rotatable turret and a second rotatable turret has at least two part supports, comprising the steps of:

placing a part on one support of the second turret;

rotating the second turret to align the supported part at a paint station with one of the shields;

mating the supported part and one shield;

painting the supported part at the paint station;

after the rotating step, replacing any part on the other part support with an unpainted part;

disengaging the shield and part at the paint station; and repeating the rotating through disengaging steps wherein after a selected number of repetitions, the first turret is rotated to locate the other shield at the paint station and said one shield is washed during subsequent repetitions of the rotating through disengaging steps.

* * * * *